United States Patent [19]

Furutsu

[11] Patent Number: 4,507,828

[45] Date of Patent: Apr. 2, 1985

[54] BUNDLING BELT DEVICE

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 514,753

[22] Filed: Jul. 18, 1983

[51] Int. Cl.[3] ..... B65D 63/00

[52] U.S. Cl. ..... 24/16 PB; 24/17 AP; 24/30.5 P; 248/74.3

[58] Field of Search ..... 24/16 PB, 17 AP, 30.5 P; 248/74.3, 74.4, 74.5; 292/318, 321, 322

[56] References Cited

U.S. PATENT DOCUMENTS

| | | | |
|---|---|---|---|
| 3,339,246 | 9/1967 | Geisinger | 24/16 PB |
| 3,368,247 | 2/1968 | Orban | 24/16 PB |
| 3,484,905 | 12/1969 | Eberhardt | 24/16 PB |
| 3,486,200 | 12/1969 | Orenick | 24/16 PB |
| 3,887,965 | 6/1975 | Schuplin | 24/16 PB |
| 3,967,345 | 7/1976 | Sumimoto | 24/16 PB |
| 4,236,280 | 12/1980 | Kreiseder | 24/16 PB |
| 4,263,697 | 4/1981 | Speedie | 24/30.5 P |

FOREIGN PATENT DOCUMENTS

| | | | |
|---|---|---|---|
| 2067240 | 7/1981 | United Kingdom | 24/16 PB |

*Primary Examiner*—Victor N. Sakran

*Attorney, Agent, or Firm*—Blum, Kaplan, Friedman, Silberman & Beran

[57] ABSTRACT

A bundling belt member molded from a synthetic resin as a one-body device comprising a head having an opening formed through the same in the axial direction of the device and a stopper member rockably formed in the opening, and a belt member extending from one end of the head and formed on its lower side surface with serrations, in a fastened condition in use of the device as applied to bundle a group of objects said stopper member being acted upon by a reaction force of the objects being bundled and firmly engaged with the serrations on the belt member.

8 Claims, 7 Drawing Figures

BUNDLING BELT DEVICE

BACKGROUND

The present invention relates to a self-locking belt-like device for bundling to a unitary arrangement a plurality of linear objects such as cables and wires or for closing the opening of bag-type containers. More particularly, the invention relates to an improved bundling belt device having an improved bundling performance.

In a variety of electric apparatus, use is made of a number of conductor wires and/or cables, and in the manufacture of such apparatus, it is widely practiced to utilize belt- or strap-type devices for orderly bundling the number of wires and/or cables group by group in order to facilitate the operation for assembling the apparatus and avoid the occurrence of any accident or error in the operation.

Bundling devices of the mentioned type are broadly classified into such ones as made of a metal and others made of a synthetic resin. With metal-made devices, while they can exhibit a high bundling strength, they are comparatively costly to manufacture and relatively difficult to handle, so that they are limited in their possible utility only to for example such cases where linear objects to be bundled are of a relatively great size and/or weight. With resin-made devices, then, they are possessed of desirable characteristics with respect to the electric insulation, flexibility, easiness for handling and so forth, and yet they can be produced in mass by molding, at a low cost, so that in recent years they have grown to be used in increasingly great numbers.

The self-locking bundling belt device according to the present invention is of the type made of a synthetic resin. Known devices of this type may be represented by the one disclosed in the U.S. Pat. No. 3,967,345 to Sumimoto. In this patent, the resin-made binding strap comprises a cylindrical head having a tongue rockably provided in the opening thereof and a strap continuously extended from a side wall portion of the head and formed on the lower side face thereof with teeth. The arrangement is such that in use of the device, the strap applied to bundle objects is inserted into the opening of the head, when the tongue in the head is meshed with the teeth on the strap as in ratchet devices. With this known binding device, the engagement between the strap and the head is effected as solely relied on a mutual meshing of the tongue and a portion of the teeth, and according to experiences with the device, there have been some difficulties encountered: It easily tends to occur that although objects to be bundled have in fact been not sufficiently bundled, the operator under the bundling operation is caused to in error assume as if a complete bundling had already been made. Further, in order to effect a tight bundling of objects, the operator is required to exert a strong force of pulling the strap passed, with its leading end portion, through the opening in the head. Particularly, it has become increasingly demanded of late that a single bundling belt device can bundle a greater number of linear objects of a same size as before or a same number of objects having a greater size than before, and in order to cope with such demands, it has grown to be required to make the device greater in size. Then, as the device is larger, less rockable becomes the tongue formed in the head, and the tongue then exerting a greater reaction force against the strap as the latter is inserted into and passed through the opening in the head, the bundling operation is inconveniently affected, resulting in a lowering of the operation efficiency. A further difficulty with the known device under reference resides in that the free end or leading end of the strap in a fastened condition of the device is projected in a perpendicular direction relative to the axes of bundled linear objects, so that not only the device presents an appearance reminding its user or an observer of a danger or an otherwise uneasy impression but also the projected free end of the strap in fact forms an obstacle to the bundling and/or transportation operations or even gives rise to a danger to the bundling operator.

SUMMARY

The object of the present invention is therefore to obviate the difficulties and shortcomings with the known bundling strap devices, and provide an improved device which advantageously makes use of a reaction force exerted by objects to be bundled against the device and thus can realize an improved bundling performance. With use of the device according to the invention, it can no longer take place that objects to be bundled are left in an insufficiently bundled condition on account of an erroneous assumption committed by the bundling operator. Also, the device can be effectively made large according to the invention so that objects can be bundled in a greater mass or in a greater bundle size with ease and in an optimum tightness.

Such objects are attained according to the invention by providing a bundling belt device molded from a synthetic resin as a one-body device comprising a head having an opening and a belt member connected to and extending from one end of the head, said opening comprising a first opening portion extending in the axial direction of the belt member and a second opening portion directed toward the lower side surface of the belt member and communicated with said first opening portion, said device having a stopper member rockably formed in a portion of the area in which said first and said second opening portions communicate with each other, said stopper member having a tooth projecting toward said first opening portion, said belt member being formed on said lower side surface with serrations, whereby in a fastened condition in use of the device as applied to bundle objects said stopper member is acted upon by a reaction force exerted by the objects being bundled so that its tooth is firmly engaged with a portion of said serrations on the belt member.

DRAWINGS

PREFERRED EMBODIMENTS

The present invention will now be described in greater detail in connection with the preferred embodiments thereof illustrated in the accompanying drawings.

Figure 1:
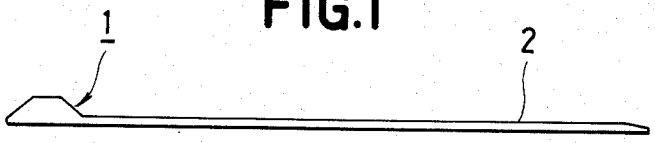
FIG. 1 shows a side elevation of a bundling belt device according to a first embodiment of the present invention.
Figure 2:
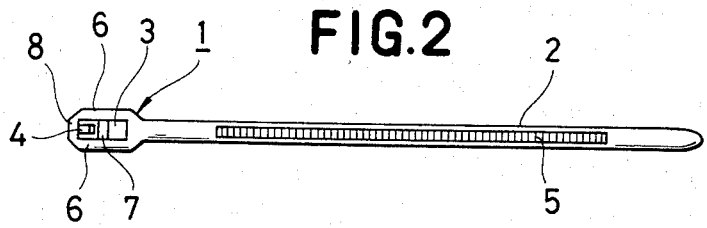
FIG. 2 shows a bottom plan of the device of FIG. 1.
Figure 3:
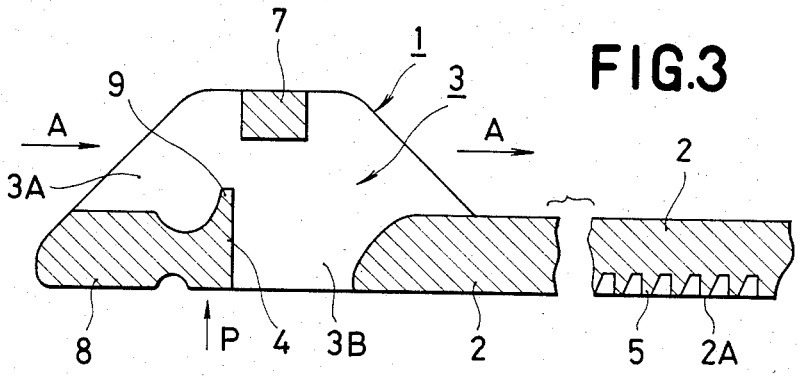
FIG. 3 is an enlarged sectional view showing essential portions of the device of FIG. 1.

The bundling belt device of the invention is molded as a one-body device from a synthetic resin, for example polyamide, and in FIGS. 1 to 3, which altogether show a first embodiment of the invention, the device comprises a head 1 and a belt member 2 extended from one side end of the head. The head 1 is formed with an opening 3, which comprises a first opening portion 3A opened through the head in the axial direction of the belt member 2 and a second opening portion 3B opened toward the bottom or lower side surface 2A of the belt member and communicated with the first opening portion 3A.

In a portion of the area at which the first and the second opening portions meet with each other, the head 1 has a rockably formed stopper member 4, which has a tooth 9 projected to the side of the frst opening portion 3A.

The belt member 2 is formed on its lower side surface with a number of serrations 5, with a portion of which the tooth 9 in the head 1 can enter into engagement when it is acted upon by a reaction force to be exerted in the direction of an arrow P by objects put for bundling with the device.

The opening 3 is defined in the head 1 by side walls 6 and 6, an upper holder element 7 and a bottom holder element 8 of the head, and in this opening 3, the stopper member 4 is formed with space from each side wall 6 in a manner such that it having a reduced thickness portion in a central part in its longitudinal direction in comparison to its portion lying closer to the side of the bottom holder element 8, it can be rocked or flexed in up and down directions in FIG. 3. That is to say, the stopper member 4 is structured so that, when the belt member 2 is applied about a group of objects to be bundled (not shown) and its leading end or free end is passed through the opening 3 in the direction of arrows A and when the device is then fastened by pulling the belt member 2 in the same direction, it can be caused by a reaction force of objects being bundled, exerted in the direction of the arrow P, to upwardly flex in FIG. 3 and become firmly engaged with correspondingly located serrations 5.

Figure 4:
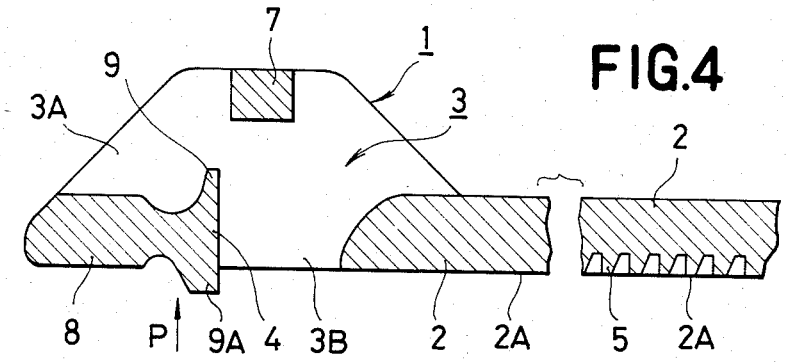
FIG. 4 is an enlarged sectional partial view similar to FIG. 3 but showing a second embodiment of the invention.

FIG. 4 shows in side elevation essential portions of a bundling belt device according to a second embodiment of the invention, and the stopper member 4 of the device of this embodiment includes a lower protrusion 9A downwardly projecting beyond the bottom surface 2A of the belt member 2. It will be readily appreciated that according to this structuring of the stopper member 4, the degree of force which the stopper 4 receives from objects being bundled can be increased or, in other words, the reaction force of objects represented by the arrow P can be more positively utilized to enhance the firmness of the engagement between the tooth 9 and the serrations 5.

Figure 5:
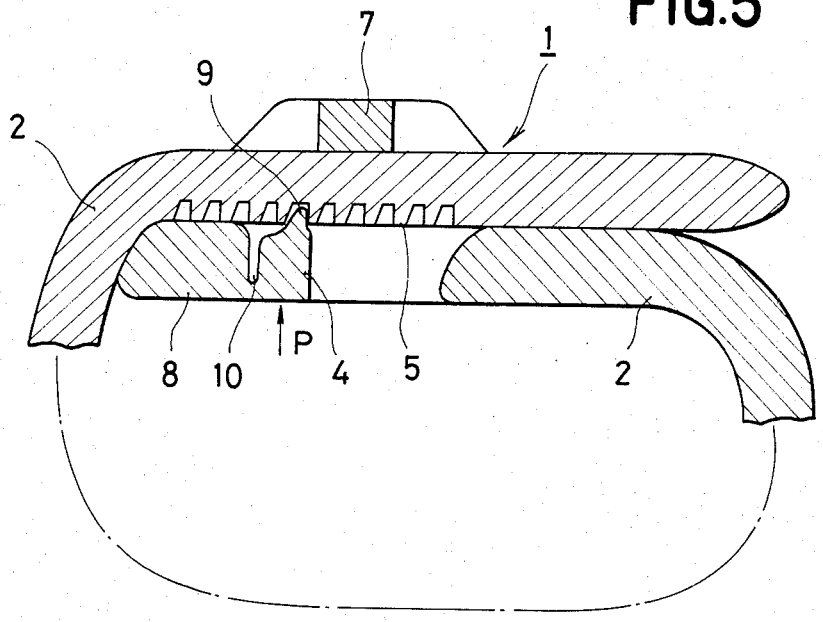
FIG. 5 is an enlarged sectional partial view, showing a bundling belt device in a fastened condition, according to a third embodiment of the invention.

FIG. 5 illustrates in section a third embodiment of the invention, according to which the device has an upwardly opened slit 10, which is formed between the bottom holder element 8 and the stopper member 4 to impart to the latter an improved ability to rock or flex. In addition, the stopper member 4 has in this case a relatively great length or thickness in the axial direction of the belt member 2, so that it has an increased surface area to receive the reaction force of objects to be bundled, represented by the arrow P, so that the positiveness is again enhanced of the engagement of the tooth 9 and the serrations 5.

Figure 6:
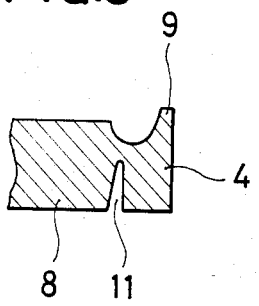
FIG. 6 is an enlarged sectional partial view, showing an essential portion of a bundling belt device representing a fourth embodiment.

FIG. 6 represents a fourth embodiment of the invention, in which the device has a slit 11 which is formed again between the bottom holder element 8 and the stopper member 4 but which now is opened toward below.

As described above, with the bundling belt device according to the present invention, it has a rockable or flexible stopper member which in turn has a tooth and it is structured so that, in a fastened condition of the device, the tooth can be acted upon by the reaction force of bundled group of objects and can thus be firmly engaged with the serrations formed on the bottom or lower side surface of the belt member. That is to say, the improvement according to the present invention resides, in principle, in that in or for a secure bundling performance of a self-locking bundling belt device, a positive utilization is advantageously made of the reaction force exerted by a group of objects to be bundled. Thus, unless it is subjected to a reaction force in reference, the stopper member will not with ease be engaged with the belt member or its serrations, so that a bundling operator can hardly be caused to make a misjudgment as often made in the case of conventional comparable devices such that where a complete bundling in fact has not been made yet, such is in error regarded as to have already taken place. Thus, with use of the device of the invention, it is feasible to always carry out a complete bundling of objects.

It may with ease be perceived that as the reaction force of objects being bundled is greater, so is the strength of the engagement between the lockably engageable members, the tooth in the head and the serrations on the belt member. Also, the bundling device according to the invention can be readily made greater in size so as to cope with the recent demand that a single device can bundle a group of objects in a greater bundle size.

Figure 7:
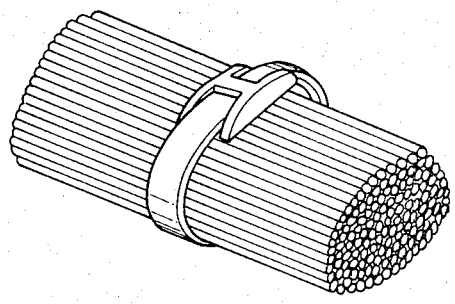
FIG. 7 shows a perspective view, taken for illustration of the manner in which linear objects are bundled with use of the device of the invention.

With the device of the invention, it is always feasible to bundle objects in a completely unitary arrangement as shown in FIG. 7. As shown, the opening in the head through which the belt member is inserted is open in the direction along the axial direction of the belt member, so that the free end portion passed through the head can extend circumferentially along the formed bundle of objects, presenting a desirable appearance and not forming an obstacle to transportation or other handling operations.

Further, in a fastened condition of the device according to the invention, the stopper member is covered under the belt member, therefore the fastened condition of the device can hardly be released externally.

As stated above, according to the present invention such a bundling belt device can be provided which can be easily fastened to bundle a number of linear objects in a desirably looking arrangement and with which the fastened condition can hardly be released, for example through an accident.

I claim:

1. A bundling belt device comprising a head having first and second ends and projecting in a first direction intermediate said first and second ends, said head having an opening, and a belt member defining an axis extending along the length thereof coupled to and extending from said first end of said head, said opening in said head including a first opening portion extending in the axial direction of said belt member for passing said belt member therethrough and a second opening portion opening in a direction opposite to said first direction in which said head projects and communicating with said first opening portion, said head having a stopper member rockably formed in a portion of the area in which said first and said second opening portions communicate with each other, said stopper member having a tooth projecting toward said first opening portion in said first direction in which said head projects, said belt member being formed with serrations on the surface thereof facing a second direction opposite to said first direction in which said head projects, said stopper member being movable in said first and second directions so that when said belt member is inserted through said first opening in a fastened condition in use of the device applied to bundle objects, said tooth of said stopper member is acted upon by a reaction force exerted by the objects being bundled so that said tooth is firmly engaged with a portion of said serrations on said belt member.

2. A bundling belt device as claimed in claim 1, wherein said opening is defined by side walls, an upper holder element and a bottom holder element.

3. A bundling belt device as claimed in claim 2, wherein said stopper member is formed with space from each of said side walls in a manner such that in a central part in its longitudinal direction, it has a reduced thickness portion in comparison to its portion lying closer to the side of said bottom holder element.

4. A bundling belt device as claimed in claim 1, wherein said head and said belt member are integrally molded from a synthetic resin.

5. A bundling belt device as claimed in claim 1, wherein said stopper member has a protrusion downwardly projecting beyond said lower side surface of the belt member.

6. A bundling belt device as claimed in claim 2, wherein an upwardly open slit is formed between said bottom holder element and said stopper member.

7. A bundling belt device as claimed in claim 6, wherein said stopper member has a relatively great length or width in the axial direction of the belt member.

8. A bundling belt device as claimed in claim 2, wherein a slit opened toward said lower side surface of the belt member is formed between said bottom holder element and said stopper member.

* * * * *